US006851348B1

(12) United States Patent
Ang

(10) Patent No.: US 6,851,348 B1
(45) Date of Patent: Feb. 8, 2005

(54) ARTILLERY FIRING MECHANISM

(75) Inventor: Teoh Hwa Ang, Singapore (SG)

(73) Assignee: Singapore Technologies Kinetics Ltd., Singapore (SG)

( * ) Notice: Subject to any disclaimer, the term of this patent is extended or adjusted under 35 U.S.C. 154(b) by 0 days.

(21) Appl. No.: 10/130,086

(22) PCT Filed: Jul. 5, 1999

(86) PCT No.: PCT/SG99/00065

§ 371 (c)(1),
(2), (4) Date: Dec. 30, 2002

(87) PCT Pub. No.: WO01/02790

PCT Pub. Date: Jan. 11, 2001

(51) Int. Cl.[7] ..... F41F 1/06; F41A 13/04; F41A 13/10; F41A 21/28

(52) U.S. Cl. ..... 89/26; 89/1.2; 89/31

(58) Field of Search ..... 89/1.2, 26, 27.14, 89/31

(56) References Cited

U.S. PATENT DOCUMENTS 2,641,162 A * 6/1953 Balleisen ..... 89/14.1
2,764,914 A * 10/1956 Young ..... 89/14.1
2,774,281 A * 12/1956 Hawkins ..... 89/1.2
2,922,339 A * 1/1960 Hawkins ..... 89/1.1
3,628,415 A * 12/1971 McElroy ..... 89/14.05
4,884,490 A * 12/1989 Hurlemann ..... 89/14.1
5,511,456 A * 4/1996 Faughn ..... 89/1.2

FOREIGN PATENT DOCUMENTS

DE 4022542 A1 * 1/1992 ..... B05B/1/02
GB 2307972 A * 6/1997 ..... F41F/1/06

* cited by examiner

*Primary Examiner*—Charles T. Jordan
*Assistant Examiner*—John W. Zerr
(74) *Attorney, Agent, or Firm*—Blakely Sokoloff Taylor & Zafman

(57) ABSTRACT

A firing apparatus (1.0) for a projectile-firing weapon of the type comprising a barrel (8) having a bore therein, the firing apparatus comprising a breech assembly (2.0) adapted to be secured to the barrel (8), a firing mechanism (5.0) adapted to initiate firing of the projectile from the bore, and a valve means (4.0)adapted to allow air within the bore, between the projectile and the firing mechanism (5.0), to be expelled from the bore during loading of the projectile through the bore.

39 Claims, 7 Drawing Sheets

ISO View

Section B-B

Side View

Side View

ARTILLERY FIRING MECHANISM

INTRODUCTION

This invention relates to an artillery firing system featuring a mechanism which enables the firing system to attain a high a prolonged rate of fire, with a built-in cooling system in order to sustain the rate of fire. The invention is particularly suitable for use in a mortar system.

PRIOR ART/PROBLEMS

The traditional and simplest way of firing a mortar is by way of a muzzle loading a mortar bomb. However, such method is unsatisfactory if a high firing rate is required. For insurance, a typical single barrel with automatic muzzle loading system. Turret Mortar Under Armour System see S/N 1 in Table A), can only achieve a rate of firing of about 12 rounds per minute. This occurs because when loading the mortar bomb from the muzzle into the mortar mechanism, air is trapped in between the mortar bomb and the barrel inside the mortar mechanism. As a result, the time taken for the mortar bomb to travel inside the barrel will be about 3 to 5 seconds and this will take up about 80% of the entire firing cycle time. Thus, a high rate of firing cannot be achieved.

Three other current mortar systems that achieve slightly higher rates of firing as compared to conventional mortar systems are as follows:

1. The Advanced Mortar System (see S/N 2 in Table A) which has twin barrels with an automatic breech loading system, has achieved a rate of firing of 14 rounds per minute. The performance compared to an increase in complexity using a breech loading operating mechanism is not only insignificant, but also doubles the weight of the whole system.
2. The Multiple Mortar System (see S/N 3 in Table A) which has four barrels and uses an automatic muzzle loading system, has achieved a rate of firing of 12 rounds in 20 seconds but with extra preparation time. The weight and size of the whole system is substantially increased. The vehicle for carrying the system will be constrained by the weight and subsequently, will degrade its manoeuverability and mobility.
3. The 82 mm AM 289 Vasilek Automatic Mortar (see S/N 4 in Table A) has an automatic breech loading system that operates like a machine gun. It has a linear magazine that holds four mortar bombs and the loading device is fitted behind the breech to allow rapid automatic firing. Only specially-designed bombs can be fitted in the magazine and although 120 rounds per minute can be fired, it still restricts the user from adopting the usage. Even though it is able to fire the standard bomb by muzzle loading, its performance will have no difference compared with other mortar systems.

TABLE A

| S/N | Description and Manufacture | Number of Barrel | Loading System | Rate of Firing Rounds/minute |
|---|---|---|---|---|
| 1 | Turret Mortar Armour System | Single | Muzzle Loading | 12 |
| 2 | Advanced Mortar System | Twin | Breech Loading | 14 |

TABLE A-continued

| S/N | Description and Manufacture | Number of Barrel | Loading System | Rate of Firing Rounds/minute |
|---|---|---|---|---|
| 3 | Multiple Mortar System | Four | Muzzle Loading | 12 rounds in 20 seconds with preparation |
| 4 | 82 mm AM 2B9 Vasilek Automatic Mortar | Single | Breech Loading | 120 Special Bomb |

Another problem faced by conventional ways of firing is that, for each round of firing, the barrel temperature will increase approximately 2 to 4° C. With high rate of firing, the barrel temperature will increase tremendously to Hot Barrel Temperature within a short span of time. This will also constrain the total number of rounds that can be fired by the barrel. Besides, the propellant charges can self-ignite within about 5 seconds at Hot Barrel Temperature. As a result, firing is inhibited when this temperature is reached. Cooling of the barrel is thus necessary for the continued usage of the mortar system. However, currently, there are no cooling systems used in any mortar system. Multiple barrels are usually the only solution to increasing the rate of firing of the mortar system.

OBJECTIVE OF THE PRESENT INVENTION (SUMMARY)

The objective of the present invention is therefore to provide an artillery firing system, particularly suitable for mortars, that will effectively reduce the loading cycle time and increase the rate of fire.

A second objective of the present invention is to provide a self-sealing valve seat assembly which can maintain an operational condition in a dirty or dusty environment and high pressures and temperatures generated by the burning propellant to ensure the effectiveness of the valve used therein.

A third objective of the present invention is to provide a cooling system in order to reduce the propensity of the system from reaching Hot Barrel Temperature while maintaining an effective high rate of fire.

SUMMARY OF THE INVENTION

The present invention involves the incorporation of a valve assembly, preferably located towards the rear of the barrel. The valve assembly allows the air trapped inside the barrel to be expelled out of the barrel when the bomb is descending into the barrel to decrease the travelling time. It also allows the system to function in a dirty or dusty environment and under high temperatures and pressures. Additionally, a cooling system associated with the firing system provides air or moisture or any other suitable coolant to be introduced into the barrel to cool the barrel. Further, the valve assembly also permits a jet of air or any other suitable propellant gas to be forced into the barrel to dislodge or expel any misfired bomb lodged in the barrel.

According to one aspect of the invention there is provided a firing apparatus for a weapon adapted to fire projectiles, the weapon being of the type composing a barrel having a bore therein, the firing apparatus comprising: a breech assembly adapted to be secured to the barrel, a firing mechanism adapted to initiate firing of the projectile from the bore; and a valve means adapted to allow air within the bore, between the projectile and the firing mechanism, to be expelled from the bore during loading of the projectile through the bore whereby the improvement comprises a blower in fluid communication with the barrel via said valve means, adapted to suck air from the bore during loading of the projectile.

It is preferred that the valve means is slidably mounted to the breech assembly and that the firing mechanism is slidably mounted to the valve means.

In the preferred emb diment, the valve means comprises a valve body and a valve seat, the valve body being movable into and out of engagement with the valve seat in order to close and open the valve means. The valve body is preferably slidably disposed within the breech assembly, and the firing mechanism is preferably slidably disposed within the valve body.

The breech assembly desirably includes an air vent through which air from the bore can be expelled by a blower to an external environment when the valve means is open. The air vent is arranged so that it is in fluid communication with the bore when the valve means is in the open position. It will be appreciated that more than one air vent may be provided.

In the apparatus according to the invention it is particularly preferred that the valve body is movable relative to the valve seat under the influence of the loading force of the projectile such that the valve body is moved into engagement with the valve seat by the force of the projectile coming into contact with the firing mechanism during loading. In other words, the force of the projectile causes the valve means to close.

It is preferred that the firing mechanism is movable relative to the valve body between first and second positions, and that the apparatus further comprises a biasing means for biasing the firing mechanism towards the first position. The biasing means may be a spring, such as a compression spring.

When the valve means and the firing mechanism are in the first relative position, the firing mechanism is preferably capable of initiating firing of the projectile, and when the valve body and the firing mechanism are in the second relative position, the firing mechanism is preferably incapable of initiating firing of the projectile. In a preferred embodiment, the valve body and the firing mechanism must be moved from the first relative position to the second relative position before the valve means can be moved from the closed position to the open position. Furthermore, when the valve means is moved from the open position to the closed position, the valve body and the firing mechanism are moved from the second relative position to the first relative position by the forces of the biasing means.

The apparatus desirably further comprises a retaining means for retaining the firing mechanism in the second position against the force of the biasing means and for retaining the valve body in engagement with the valve seat. The arrangement is such that when the retaining means retains the firing mechanism in the second position, the valve body is movable relative to the valve seat; and when the retaining means retains the valve body in engagement with the valve seat, the firing mechanism is movable relative to the valve body. The retaining means preferably comprises a retaining member, a first recess provided in the spring mechanism, a second recess provided in the breech portion, and an aperture provided in the valve body, the retaining member being disposed in the valve body aperture and in one or the other of the first and second recesses, the arrangement being such that when the firing mechanism and the valve body are in the first relative position, the valve body aperture is aligned with the second recess and the retaining member is disposed in the valve body aperture and the second recess, and when the firing mechanism and the valve body are in the second relative position, the valve body aperture is aligned with the first recess and the retaining member is disposed in the valve body aperture and the first recess.

When the valve body and the valve seat are in the closed position, movement of the firing mechanism to the second position preferably cause the first recess to be brought into alignment with the valve body aperture and the second recess whereby the retaining member can move from the second recess into the first recess upon the application of a force to move the valve body out of engagement with the valve seat. When the valve body and the valve seat are in the open position, movement of the valve body into engagement with the valve seat preferably causes the second recess to be brought into alignment with the valve body aperture and the first recess, whereby the retaining member can move from the first recess into the sec nd recess upon the application of the force of the biasing means.

It is preferred that retaining member is substantially spherical, and most preferably, there are three of said retaining members arranged about the firing mechanism.

The firing mechanism preferably comprises a firing pin mounted on a support shaft, the firing pin and the support shaft being movable relative to the valve body. The firing mechanism preferably further comprises a housing, fixedly secured to the valve body, whereby the firing pin and the support shaft are movable relative to the housing, the housing having an aperture through which the firing pin can move in order to engage the projectile. The arrangement may be such that: when the valve means and the firing mechanism are in the first relative position, the firing pin is disposed in the housing aperture and may be struck by the projectile, thereby initiating firing thereof, and when the valve means and the firing mechanism are in the second relative position, the firing pin is not disposed in the housing aperture and may not be struck by the projectile. The first recess may be provided in the support shaft of the firing mechanism. The housing, is fixedly secured to the valve body so that it is only the firing pin and the support shaft of the firing mechanism which are movable relative to the valve means.

An actuating means is preferably provided which is adapted to move the valve body out of engagement with the valve seat, and is preferably further adapted to move the firing mechanism and the valve means from the first relative position to the second relative position. In a preferred embodiment, the actuating means comprises a support secured to the valve body, and a lever secured to the firing mechanism and pivotally mounted to the support, whereby pivotal movements of the lever about the support causes the relative movement between the valve body and the firing mechanism.

The valve seat is preferably provided on the breech assembly. The valve seat advantageously includes an elastomeric seal body which is engaged by the valve body when the valve means is in the closed position, the seal body being adapted to seal against an inner surface of the barrel upon firing of the projectile. The valve seat may further comprise a retaining member adapted to retain the seal body in engagement with the barrel.

In advantageous embodiment of the invention, the apparatus further comprises cooling means adapted to cool the barrel during and/or after firing of the projectile. The cooling means may be adapted to deliver cooling gas and/or cooling liquid to the bore. A further embodiment may be sought, wherein the valve means comprises a valve body and valve seat, the valve body being movable into and out of engagement with the valve seat in order to close and open the valve means. The cooling medium would be comprised of either a cooling gas, and cooling liquid or a combination thereof. The cooling means preferably delivers said cooling gas and/or cooling liquid when the valve means is in the open position, said cooling gas and/or cooling liquid being delivered to the bore through the gap between the valve body and the valve seat.

In one embodiment, the cooling means includes a cooling gas inlet in the breech through which cooling gas can be pumped into the bore when a valve means disposed between the projectile and the firing mechanism is open. The cooling gas inlet is preferably the same the air vent described above. Furthermore, the cooling gas may be pumped into the bore using the same pump as the pump used to pump air out of the bore through the air vent; alternatively, two different pumps may be used.

In one embodiment, the cooling means includes a cooling liquid inlet in the breech assembly through which cooling liquid can be pumped into the bore when the valve means is open. The breech assembly may include an air vent through which air from the bore can be expelled by said blower to an external environment when the valve means is open.

It is preferred that the cooling gas inlet and/or the cooling liquid inlet are arranged at an angle to the longitudinal axis of the bore which is in the range 40° to 60°, and which is most preferably substantially 50°, and tangentially to the inner surface of the bore. It will be appreciated that more than one cooling gas inlet and/or cooling liquid inlet may be provided.

It is further preferred that each cooling liquid inlet is arranged to alternate with a cooling gas inlet. The cooling gas is injected first to form a cyclonic airflow followed by injecting the cooling liquid.

The operation and structure of the preferred form of the invention should now be clear from the foregoing. Prior to loading of the projectile, the valve means is retained in the closed position by the retaining means, and the firing mechanism and the valve means are in the first relative position. The actuating means is then used to moved the valve means and the firing mechanism from the first relative position to the second relative position, against the force of the biasing means. This may be done by a human operator, or the process may be automated. When the valve means and the firing mechanism are in the first relative position, the retaining means now permits the valve body to move relative to the valve seat to open the valve means. While the valve means is in the open position, the retaining means will not permit any relative movement between the valve means and the firing mechanism. When the valve means reaches the open position, a projectile may be loaded into the bore through the muzzle of the barrel. As the projectile drops towards the firing mechanism, the air trapped in the bore can be expelled through the air vent in the breech assembly, with the assistance of the pump. The projectile eventually impacts the firing mechanism housing and this causes the valve body to move into contact with the valve seat and to close the valve. When the valve means is closed the retaining means permits the biasing means to force the valve means and the firing mechanism back into the first relative position. When this happens, the firing pin is moved through the aperture in the housing and into engagement with the projectile, thereby initiating firing of the projectile. The burning of propellant created by firing of the projectile builds up a pressure within the bore which presses the valve body against the valve seat and presses the valve seat against the breech assembly; in order to prevent leakage of hot gases through the air vent. The cycle is then repeated.

Furthermore, when the valve means is opened the cooling means is activated to deliver cooling gas and/or cooling liquid to the bore. Furthermore, the blower may be utilised to inject a jet of a gas and/or liquid to expel a misfired projectile from the bore when the valve means is open.

According to another aspect of the invention, there is provided a firing apparatus for a weapon adapted to fire projectiles, the weapon being of the type comprising a barrel having a bore therein, the firing apparatus comprising: a breech assembly adapted to be secured to the barrel; a firing mechanism adapted to initiate firing of the projectile from the bore, and a cooling means adapted to deliver a medium comprised to either of a cooling gas, a cooling liquid or a combination thereof to the bore after firing of the projectile. The firing apparatus according to this aspect of the invention may include any combination of the features of the firing apparatus according to the first aspect of the invention.

According to another aspect of the invention there is provided a weapon comprising a barrel having a bore therein for firing a projectile, and a firing apparatus as described above provided on the barrel extending inwardly from one end thereof. The firing apparatus may be secured to the barrel or may be integral therewith.

Preferably the weapon is an artillery gun, most preferably a mortar gun.

BRIEF DESCRIPTION OF THE DRAWINGS

All drawings shown herein relate to one embodiment of the invention.

DESCRIPTION OF THE INVENTION ILLUSTRATED WITH A PREFERRED EMBODIMENT

The Firing Cycle

Figure 1:
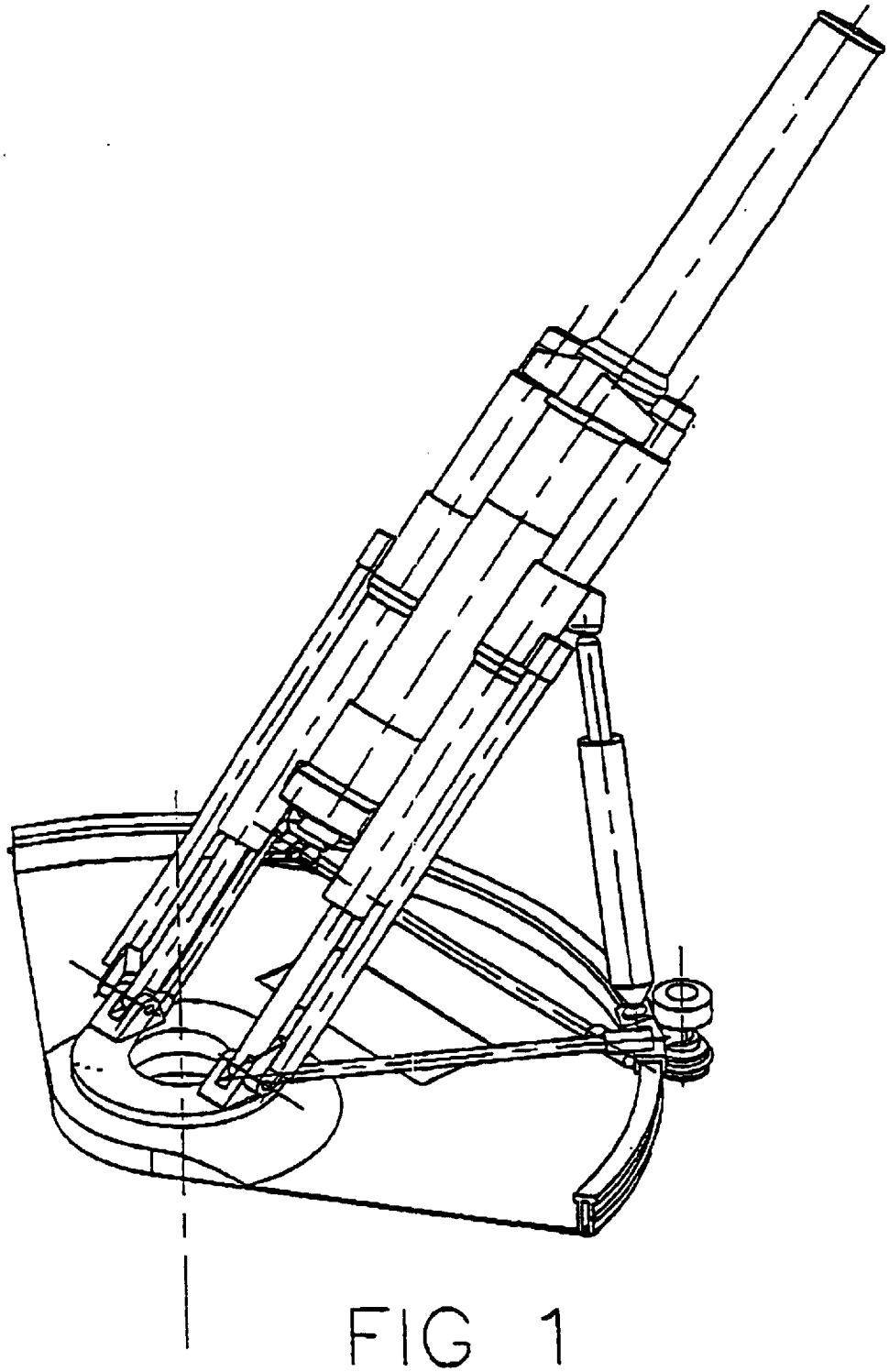
FIG. 1 is a perspective view of the mortar system.
Figure 2:
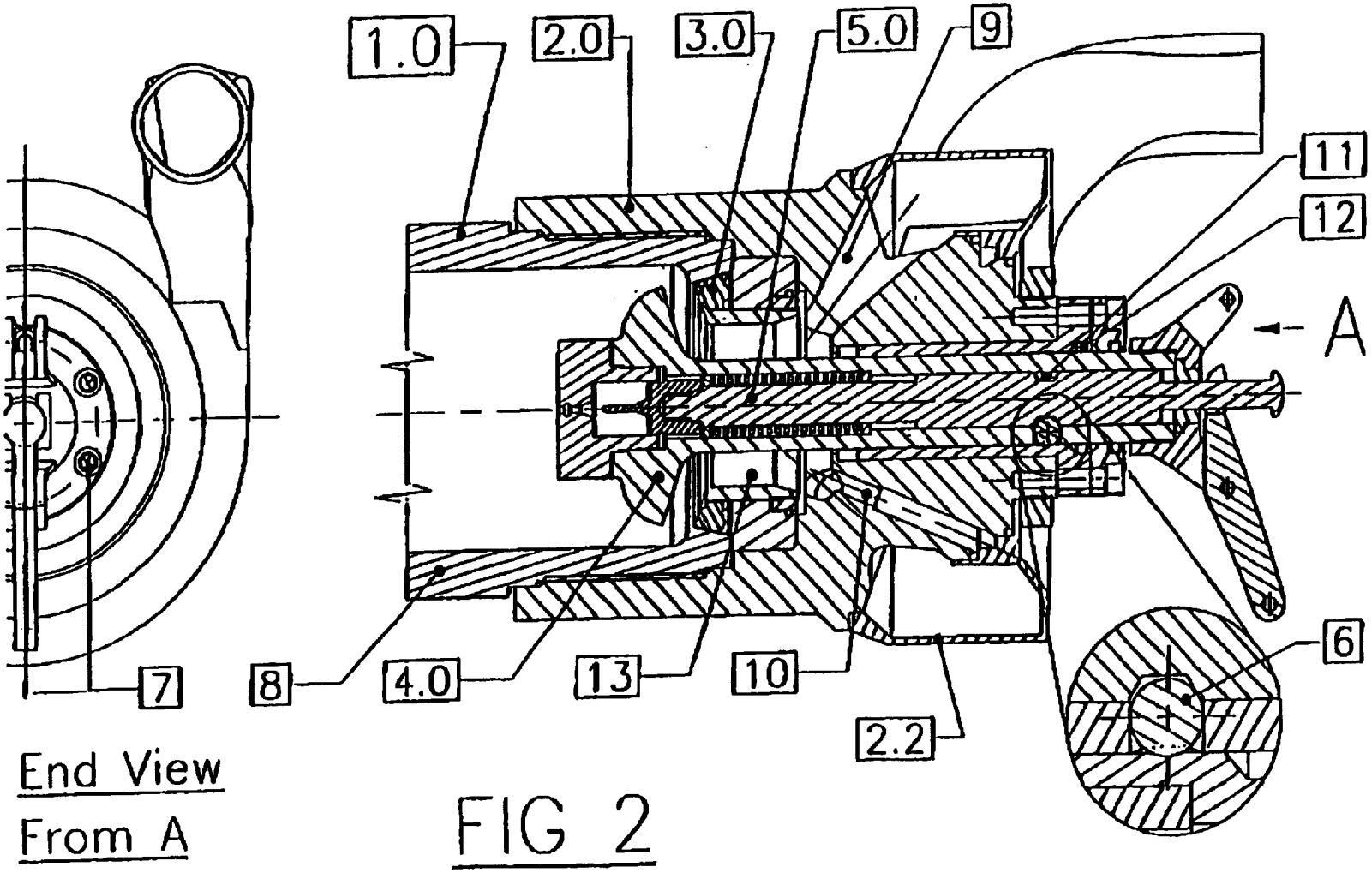
FIG. 2 is a side view of a breech assembly having an opened valve according to a preferred embodiment of the invention.
Figure 3:
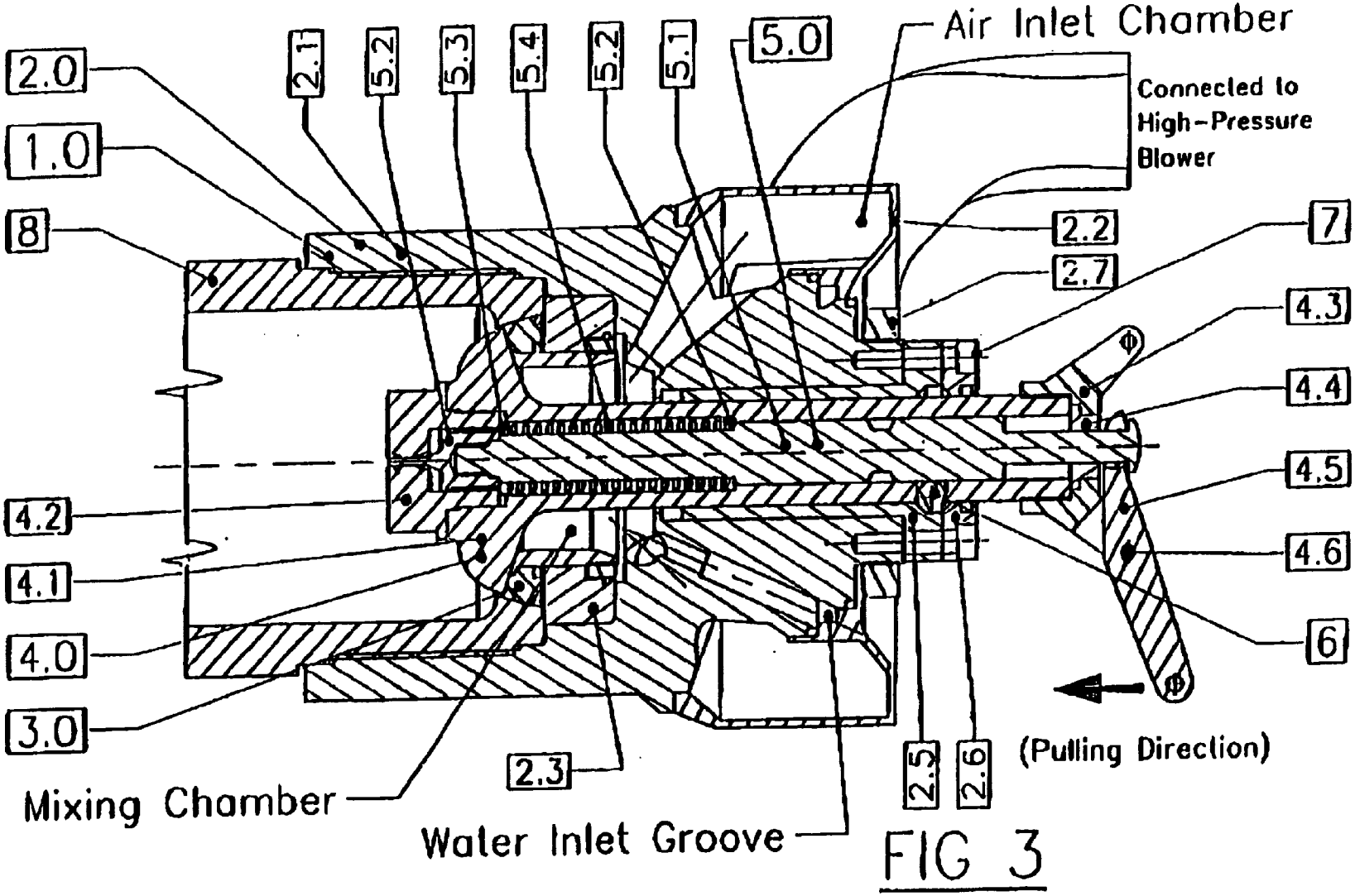
FIG. 3 is a side view of a breech assembly having a closed valve.

FIGS. 2 and 3 show one preferred embodiment of the invention, namely a mortar system assembly (1.0) with a bush (2.5) which is relatively stationary as compared to the firing pin assembly (5.0) during the firing process. The mortar system (1.0) has a lever (4.5) at the rear end, and a breech assembly (2.0) that holds a valve assembly (4.0). A firing pin assembly (5.0) with a spring (5.4), is secured to the valve assembly (4.0) and 3 balls (6) are adjacent to the firing pin assembly (5.0). The valve body (4.1) adjacent to the bush (2.5), is engaged to the said bush (2.5) by having the balls (6) locked in between the valve body (4.1) and the bush (2.5). There are inner and outer grooves (11 and 12) located towards the rear end of the valve body (4.1), whereby a pull on the lever (4.5), will result in a resilient force being built up on the spring (5.4) of the firing pin assembly (5.0), such that the firing pin assembly (5.0) retracts until the inner groove (11) is aligned with the balls (6). The balls (6) will be forced rearwards by the cocking movement, allowing the valve body (4.1) to move forward to an opened position. The firing pin assembly (5.0) is coupled with the balls (6) and will remain in this locked position. Upon releasing the lever (4.5), the retaining force of the valve body (4.1) generated by the spring (5.4) of the firing pin assembly (5.0) will force the balls (6) to sit on the bush (2.5).

During loading of a mortar b mb, the valve assembly (4.0) will remain locked in the opened position when the mortar bomb is travelling down the barrel (8). This allows trapped air to be sucked outwardly by the high-pressure blower pipes (not shown) that are connected through pipes to the air inlet holes (9) in order to reduce loading time to about 0.5 seconds, allowing about 30 rounds of firing per minute. Once the mortar bomb is in contact with the firing pin housing (4.2), the momentum of the mortar bomb will be transferred to the valve body (4.1) in order to overcome the retaining force exerted by the balls (6). The valve body (4.1) is then pushed towards a closed position with the balls (6) in alignment with an outer groove (12) being located at the rear end of the bush (2.5). At this position, the valve (4.0) will be closed and the spring (5.4) will force the firing pin assembly (5.0) forward which will push the balls (6) outward into the outer groove (12). Once the valve assembly (4.0) is closed, the firing pin assembly (5.0) will move forward in full force. The momentum of the firing pin assembly (5.0) will result in over-travelling. The protrusion of the firing pin (5.5) from the firing pin housing (4.2) will in turn strike the primer on the mortar bomb causing the firing of the bomb.

The Valve Seat Assembly

The pressure and temperature of firing gas are extremely high during firing (1,500 bar @ higher than 1,300° C.) and the build-up is within a few milliseconds. There will be propellant residues and aluminum clips remaining in the barrel after firing which are formed from incomplete burning of propellant charges.

Figure 4:
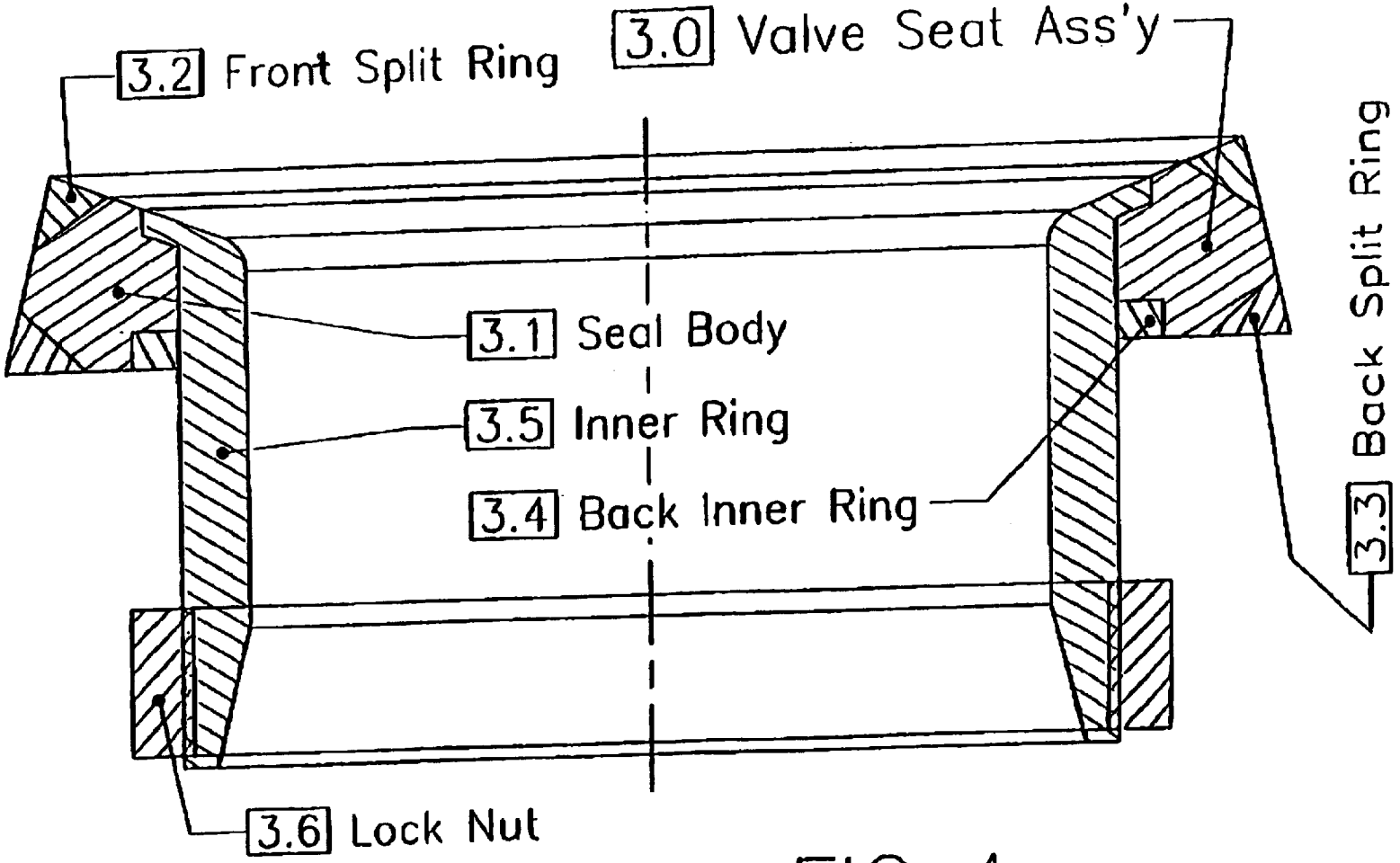
FIG. 4 is a cross-sectional view of a valve seat assembly.
Figure 5:
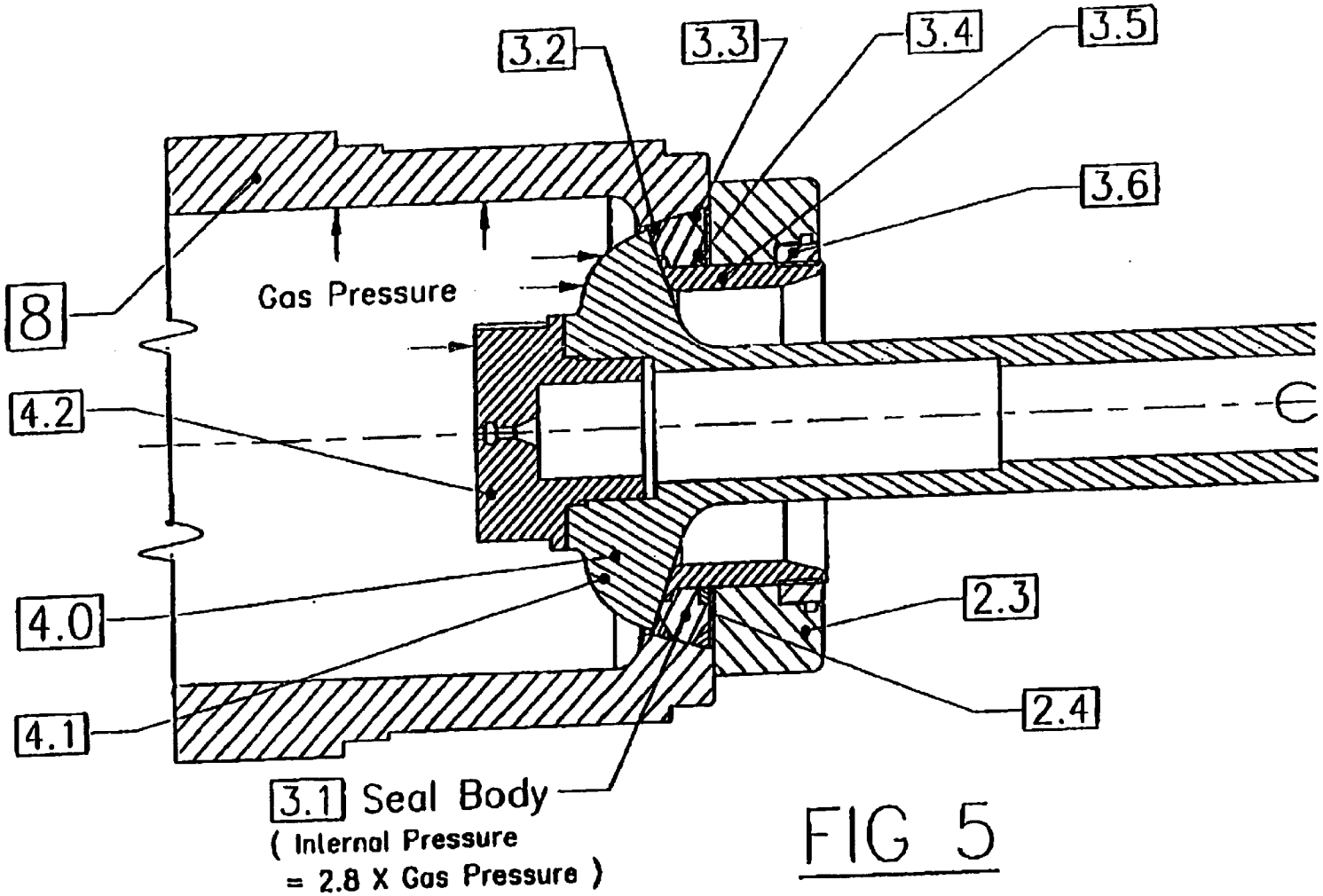
FIG. 5 is an enlarged view of the part of the breech assembly containing the valve seat assembly.

FIGS. 4 and 5 show a valve seat assembly (3.0) adjacent to the valve (4.1) which encompasses a seal body (3.1) as its main component, which is made of reinforced Elastomer-based material. A front split ring (3.2) is adjoined to the barrel (8) as well as with the valve body (4.1). The front split ring (3.2) and the back split ring (3.3) are in contact with the barrel (8). Each split ring is comprised of about 3 cut segments, each of substantially equal length, which will be forced together under high pressure. This ensures that the gap in the valve seat assembly (3.0) is fully closed under high pressure.

An inner ring (3.5) and a back inner ring (3.4) are in contact with a backing plate (2.4) on the valve seat holder (2.3) in the valve-closed position. The front split ring (3.2) and the inner ring (3.5) are in contact with the valve body (4.1). During firing, the gas pressure generated at the barrel side acts on the valve assembly (4.0) and the firing pin housing (4.2). The only support that acts against the gas pressure on the breech side is the valve seat holder (2.3) that is in contact with the seat body (3.1), the back inner ring (3.4) and the inner ring (3.5). Such an arrangement magnifies the pressure built-up in the seat body (3.1) by 2.8 times of the gas pressure in the barrel. This effect is caused by the difference between the area of gas pressure acting on the barrel side against the area of support on the seat body (3.1). Under such high pressure, the seal body (3.1) is compressed and subsequently deformed to seal off all the contact surfaces. The front split ring (3.2) functions mainly to protect the seal body (3.1) from being in contact with high temperature gas and to prevent the seal body (3.1) from being extruded. The sealing surface being flexible, its operation will not be affected by small foreign particles that may be trapped in-between the sealing surfaces. This self-sealing action of the seal body (3.1) therefore allows effective and reliable use of the valve seat (3.0) to prevent the firing gas from penetrating the valve when the valve is in the closed position.

The Cooling System

Figures 6, 7, 8:
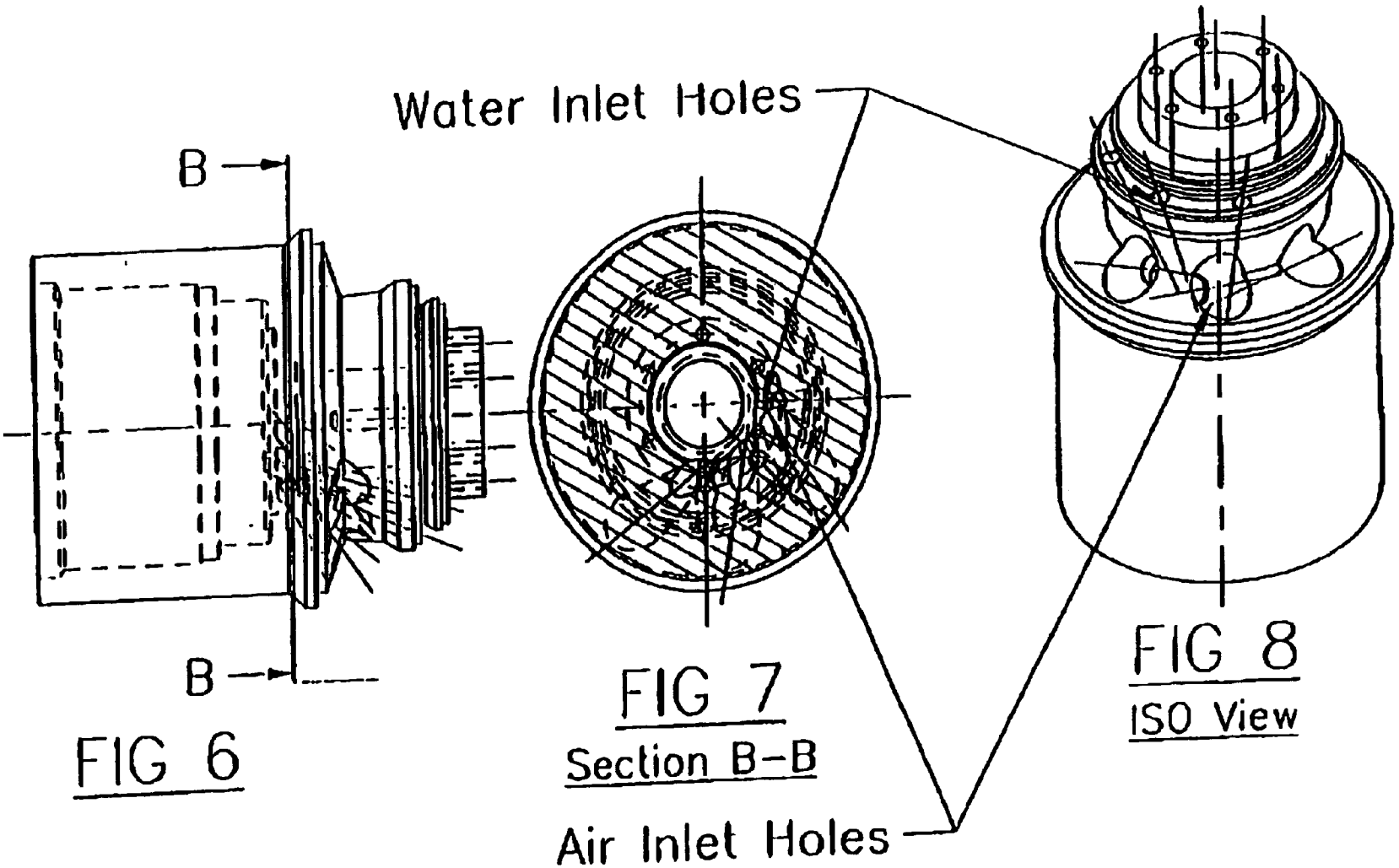
FIG. 6 is a side view of the breech assembly showing the air and water inlet holes of the cooling system.
FIG. 7 is a cross-sectional view of the breech assembly taken at Section B—B of FIG. 6.
FIG. 8 is an isometric view of the breech assembly of FIG. 6.
Figure 10:
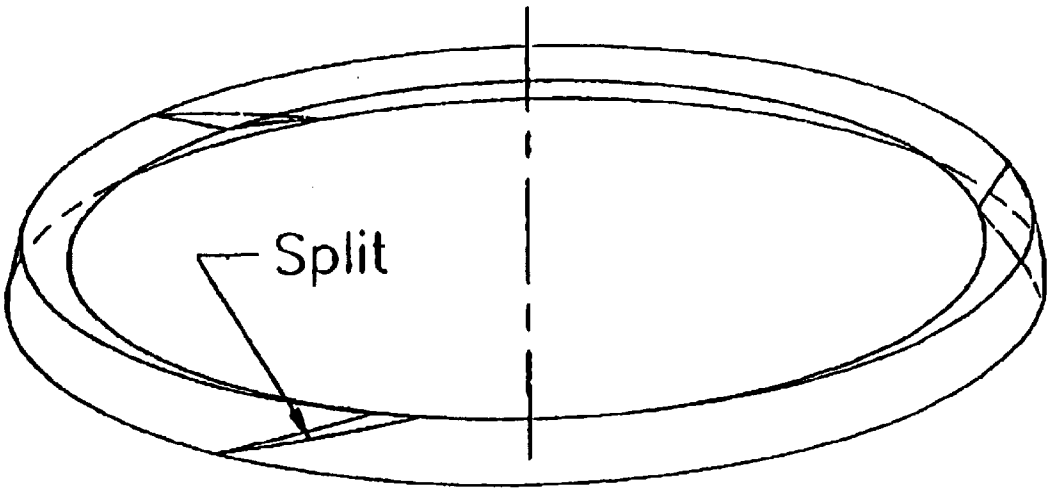
FIG. 10 is an isometric view of a split ring found in the valve seat assembly.
Figure 9:
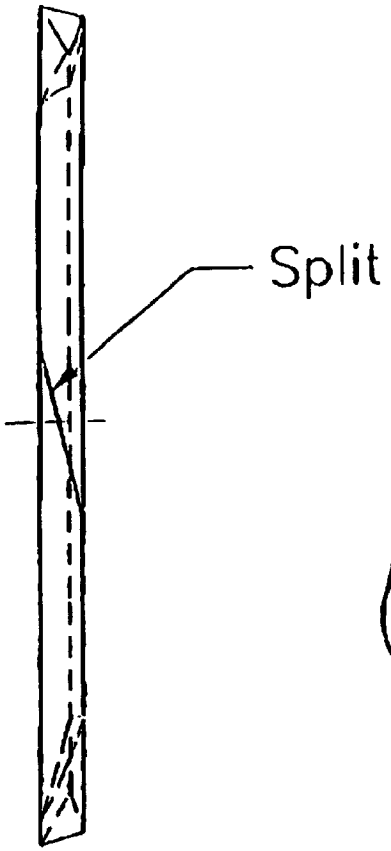
FIG. 9 is a cross-sectional view of a split ring found in the valve seat assembly.

FIGS. 6 (Side View), 7 (Section View) and 8 (Isometric View) show that details of the air and water inlet holes on the breech piece (2.1). In FIGS. 2 and 3, the air inlet cover (2.2) is secured onto the breech piece (2.1) by the lock-nut (2.7), and they form an air inlet chamber and a water inlet groove. The air inlets cover (2.2) is connected to the high-pressure blower and the water supply (not shown). The air inlet holes (9) are arranged at an angle in the range of 40° to 60° to the longitudinal axis of the bore and tangential to the inner surface of the mixing chamber. When inlet air is forced through the tapered inlet holes tangentially to the mixing chamber, the velocity of the airflow will be further boosted by the jet-effect of the tapered holes. Therefore, a cyclonic airflow through the barrel is created.

The water jet assemblies (not shown) are installed in the water holes (10). The tip of the water jet nozzles is at the edge of the mixing chamber. Each water jet nozzle alternates with another air inlet hole. Optimized mixing of air and water-mist is achieved by such an arrangement. Most of the water-mist will remain as droplets until it is in the barrel because most of it only travelled a very short distance. When the valve assembly (4.0) is in an opened position (see FIG. 2) the air will be injected first to generate a cyclonic airflow followed by injecting water. The water droplets are forced to stick onto the inner surface of the barrel due to the centrifugal force of the cyclonic airflow. The water droplets will be evaporated upon contact with the hot barrel (8), which is a very effective means of removing heat from the barrel. Thus, this novel cooling process, which takes place in between firing and during idling, effectively cools the barrel (8).

In one embodiment of the invention, the injection of the air and moisture can be achieved by utilising a shock sensor or the like to detect the stage of the firing cycle and further, a microprocessor can be used to control the solenoid valves to regulate volume and frequency of air and moisture to be injected.

Example A below illustrates the cooling effect achieved by using the cooling system of the present invention.

EXAMPLE A

Heat Generated per Round Fired

Temperature increase per round fired assumed to be 3° C.

Weight of the Barrel assumed to be 80 kg

Therefore, 80 kg×3° C.×0.11=26,400 Calories

Amount of water required for c mpletely removing the heat generated

Heat of Vaporization of water at 1 atm:540 Calories/gram

Therefore, 26,400 Calories±540 Calories/gram≅49 gram (theoretical)

Convection Heat Transfer Coefficient 5,000~50,000 W/m$^2$ °C. (depending on the temperature difference)

1 kW=239 Calories/second; Round-off to 240 Calories/second

Therefore 1,200~12,000 Calories/second

Water Flow Estimated

The surface area of the Barrel Bore: ϕ0.12 m×π×2 m L=0.75 m$^2$

If the heat Transfer Co-efficient of 12,000 Calories/second is achievable, then the optimal water flow rate should be:

$$\frac{12000Cal \times 0.75}{540Cal} = 16.67 \text{ gm/sec}$$

Cooling Cycle Time and its Efficiency

Time taken to load the mortar bomb and for it to travel inside the barrel 0.8 sec Time taken to fire, recoil until the cooling valve opens 0.1 sec Time taken to dry the barrel 0.3 sec Sub Total: 1.2 sec The total cycle—1.2 sec will be the time available for cooling the barrel.

| | Rate of Firing Rds/min | | | | |
|---|---|---|---|---|---|
| | 30 | 25 | 20 | 15 | 10 |
| Cycle time sec | 2 | 2.4 | 3 | 4 | 6 |
| Cooling time sec | 0.8 | 1.2 | 1.8 | 2.8 | 4.8 |
| Cooling Efficiency | | | | | |
| 12,000 Cal/sec | 36% | 55% | 82% | 127% | 218% |
| 6,000 Cal/sec | 18% | 27% | 41% | 64% | 109% |

The Blower and its Sizing

The blower has one blowing outlet and one suction port. The primary function of blowing air is to carry moisture to cool the barrel, dry the barrel after cooling and clean the valve seat. The suction is used to remove the trapped air in between the barrel and mortar bomb during loading.

Conventionally, an extracting mechanism is used to remove a misfired bomb in the barrel. The blower may also be utilised to inject a jet of air and/or moisture to expel a misfired bomb in the barrel easily, as compared to conventional methods.

In one embodiment of the invention, the Ring Blower is powered by a 3.7 kW motor, which will generate an Airflow of 5 m$^3$/min @ 0.24 bar.

The Airflow of 5 m$^3$/min @ 0.24 bar will become 6.2 m$^3$/min after depressurization.

The cross-section area of the barrel $$\frac{0.12 \text{ m}^2}{4} \times \pi = 0.0113 \text{ m}^2$$

Thus, the linear airflow velocity in the barrel will be $$\frac{6.2 \text{ m}^3/\text{min}}{0.0113 \text{ m}^2 \times 60 \text{ sec}} = 914 \text{ m/sec}$$

The time taken for the air to flow throughout the barrel will be:

$$\frac{2m}{9.14 \text{ m/sec}} = 0.22 \text{ sec}$$

To ensure the barrel is dry before loading the next round, bl wing of dry air for a minimum of 0.3 sec is required. Therefore, the 0.3 sec should be included in the total time that is available for cooling.

System function and time line

| S/N | Function | Time Line | Duration sec |
|---|---|---|---|
| 1 | Firing starts | 0 | — |
| 2 | Arm the firing pin and open the valve by a single pulling action of the lever. | −0.1 | 0.1 |
| 3 | Timing begins | 0 | — |
| 4 | Move the mortar bomb into the barrel muzzle and release. The loading mechanism moves away, receives the next mortar bomb and ready for loading within 1.7 sec concurrently. | 0.3 | 0.3 |
| 5 | Time taken for the mortar to travel inside the barrel | 0.8 | 0.5 |
| 6 | The mortar bomb pushes the valve to close and activates the firing pin | 0.9 | 0.1 |
| 7 | The mortar bomb fires off and recoil takes place | 0.9 | 0.3 |
| 8 | Repeat S/N 2, blowing of air begins | 1.0 | 0.1 |
| 9 | Spraying of water begins | 1.1 | 0.1 |
| 10 | Stop the spraying of water | 1.7 | 0.6 |
| 11 | Stop the blowing of air | 2.0 | 0.3 |
| 12 | Firing cycle completed or repeat S/N.3 to 11 for continual firing | 0 | — |

The invention described herein is susceptible to variations, modifications and/or additions other than those specifically described and it is to be understood that the invention includes all such variations, modifications and/or additions which fall within the spirit and scope of the above description. Although the preferred embodiment of the invention mentioned above relates to a mortar firing system, the invention may also be suitable for other types of artillery systems.

PARTS LIST WITH REFERENCE TO THE DRAWINGS

| Part No. | Name of Part |
|---|---|
| 1.0 | Mortar System Assembly |
| 2.0 | Breech Assembly |
| 2.1 | Breech Piece |

-continued

PARTS LIST WITH REFERENCE TO THE DRAWINGS

| Part No. | Name of Part |
|---|---|
| 2.2 | Air Inlet Cover |
| 2.3 | Valve Seat Holder |
| 2.4 | Backing Plate |
| 2.5 | Bush |
| 2.6 | Seal Housing |
| 2.7 | Lock-Nut Air Inlet Cover |
| 3.0 | Valve Seat Assembly |
| 3.1 | Seal Body |
| 3.2 | Front Split Ring |
| 3.3 | Back Split Ring |
| 3.4 | Back Inner Ring |
| 3.5 | Inner Ring |
| 3.6 | Lock-Nut |
| 4.0 | Valve Assembly |
| 4.1 | Valve Body |
| 4.2 | Firing Pin Housing |
| 4.3 | End Cap, Lever |
| 4.4 | Split Bush |
| 4.5 | Lever |
| 4.6 | Pivot Pin |
| 5.0 | Firing Pin Assembly |
| 5.1 | Firing Pin Extension |
| 5.2 | Spacer Rear |
| 5.3 | Spacer Front |
| 5.4 | Spring |
| 5.5 | Firing Pin |
| 6 | Ball |
| 7 | Cap Screw |
| 8 | Barrel |

What is claimed is:

1. A firing apparatus for a barrel loading projectile-firing weapon of the type comprising a barrel having a bore therein, the firing apparatus comprising:

a breech assembly adapted to be secured to the barrel;

a firing mechanism adapted to initiate firing of the projectile from the bore;

a valve means adapted to allow air within the bore, between the projectile and the firing mechanism, to be expelled form the bore during loading of the projectile through the bore; and a blower in fluid communication with the barrel via said valve means, adapted to suck air from the bore during loading of the projectile.

2. Apparatus according to claim 1, wherein the valve means comprises a valve body and a valve seat, the valve body is slidably mounted to the breech assembly and the firing mechanism is slidably mounted to the valve seat.

3. Apparatus according to claim 1, wherein the valve means comprises a valve body and a valve seat, the valve body being movable into and out of engagement with the valve seat in order to close and open the valve means.

4. Apparatus according to claim 3, wherein the breech assembly includes an air vent through which air from the bore can be expelled by said blower to an external environment when the valve means is open.

5. Apparatus according to claim 3, wherein the valve body is movable relative to the valve seat under the influence of the loading force of the projectile such that the valve body is moved into engagement with the valve seat by the force of the projectile during its loading coming into contact with the firing mechanism.

6. Apparatus according to claim 2, wherein the firing mechanism is movable relative to the valve body between first and second positions, and wherein the apparatus further comprises a biasing means for biasing the firing mechanism towards the first position.

7. Apparatus according to claim 6, wherein when the valve body and the firing mechanism are in the first position, the firing mechanism is capable of initiating firing of the projectile, and when the valve body and the firing mechanism are in the second position, the firing mechanism is incapable of initiating firing of the projectile.

8. Apparatus according to claim 7, wherein the valve body and the firing mechanism must be moved from the first position to the second position before the valve means can be moved from a closed position to an open position and when the valve means is moved from the open position to the closed position, the valve body and the firing mechanism are moved from the second position to the first position by the force of the biasing means.

9. Apparatus according to claim 6, further comprising a retaining means for retaining the firing mechanism in the second position against the force of the biasing means and for retaining the valve body in engagement with the valve seat the arrangement being such that when the retaining means retains the firing mechanism in the second position, the valve body is movable relative to the valve seat and when the retaining means retains the valve body in engagement with the valve seat the firing mechanism is movable relative to the valve body against the force of the biasing means.

10. Apparatus according to claim 9, wherein the retaining means comprises a retaining member, a first recess provided in the firing mechanism, a second recess provided in the breech assembly and an aperture provided in the valve body the retaining member being disposed in the valve body aperture and in one or the other of the first and second recesses the arrangement being such that when the firing mechanism and the valve body are in the first position, the valve body aperture is aligned with the second recess and the retaining member is disposed in the value body aperture and the second recess and when the firing mechanism and the valve body are in the second position, the valve body aperture is aligned with the first recess and the retaining member is disposed in the valve body aperture and the first recess.

11. Apparatus according to claim 10, wherein when the valve body and the valve seat are in a closed position, movement of the firing mechanism to the second position causes the first recess to be brought into alignment with the valve body aperture and the second recess, so that the retaining member can move from the second recess into the first recess upon the application of a force to move the valve body out of engagement with the valve seat, whereby the valve means can be moved from the closed to an open position.

12. Apparatus according to claim 10, wherein when the valve body and the valve seat are in an open position, movement of the valve body into engagement with the valve seat causes the second recess to be brought into alignment with the valve body aperture and the first recess so that the retaining member moves from the first recess into the second recess upon the application of the force of the biasing means whereby the valve means and the firing mechanism move to the first position under the force of the biasing means.

13. Apparatus according to claim 10, wherein the retaining member is substantially spherical.

14. Apparatus according to claim 10, wherein there are three retaining members arranged about the firing mechanism.

15. Apparatus according to claim 3, wherein the firing mechanism comprises a firing pin mounted on a support shaft the firing pin and the support shaft being movable relative to the valve body, and the firing mechanism further comprises a housing fixedly secured to the valve body whereby the firing pin and the support shaft are movable relative to the housing, the housing having an aperture through which the firing pin can move in order to engage the projectile.

16. Apparatus according to claim 10, wherein the firing mechanism comprises a firing pin mounted on a support shaft, the firing pin and the support shaft being movable relative to the valve body, and the firing mechanism further comprises a housing fixedly secured to the valve body whereby the firing pin and the support shaft are movable relative to the housing, the housing having an aperture through which the firing pin can move in order to engage the projectile, wherein the first recess is provided in the support shaft of the firing mechanism.

17. Apparatus according to claim 3, further comprising an actuating mean adapted to move the valve body out of engagement with the valve seat.

18. Apparatus according to claim 17, wherein the actuating means is further adapted to move the valve means and the firing mechanism from a first position to a second position.

19. Apparatus according to claim 18, wherein the actuating means comprises a support secured to the valve body, and a lever secured to the firing mechanism and pivotally mounted to the support whereby pivotal movement of the lever about the support causes the relative movement between the valve body and the firing mechanism.

20. Apparatus according to claim 3, wherein the valve seat is provided on the breech assembly.

21. Apparatus according to claim 3, wherein the valve seat includes an elastomeric seal body which is engaged by the valve body when the valve means is in the closed position, the seal body being adapted to seal against an inner surface of the barrel upon firing of the projectile.

22. Apparatus according to claim 21, wherein the valve seat further comprises a retaining member adapted to retain the seal body in engagement with the barrel.

23. Apparatus according to claim 1, further composing cooling means adapted to cool the barrel after firing of the projectile.

24. Apparatus according to claim 23, wherein the cooling means is adapted to deliver a cooling medium comprised of either a cooling gas, a cooling liquid, or a combination thereof to the bore.

25. Apparatus according to claim 24, wherein the valve means comprises a valve body and a valve seat, the valve body being movable into and out of engagement with the valve seat in order to close and open the valve means and wherein the cooling means delivers said cooling medium when the valve means is in the open position, said cooling medium being delivered to the bore through the gap between the valve body and the valve seat.

26. Apparatus according to claim 25, wherein the cooling means includes a cooling gas inlet in the breech assembly through which the cooling gas can be pumped into the bore when the valve means is open.

27. Apparatus according to claim 25 wherein a plurality of cooling gas inlets are provided the cooling gas inlets are arranged spaced at an angle of between 40° and 60° looking down the longitudinal axis of the bore and tangential to the inner surface of the bore.

28. Apparatus according to claim 26, wherein the breech assembly includes an air vent through which air from the bore can be expelled by said blower to an external environment when the valve means is open, wherein the cooling gas inlet is the same as the air vent and the cooling gas is air.

29. Apparatus according to claim 25, wherein the cooling gas is pumped into the bore by a high-pressure blower.

30. Apparatus according to claim 25, wherein the cooling means includes a cooling liquid inlet in the breech assembly through which cooling liquid can be pumped into the bore when the valve means is open.

31. Apparatus according to claim 24, wherein each of a plurality of cooling liquid inlets is arranged so that it alternates with a cooling gas inlet in the breech assembly.

32. Apparatus according to claim 25, wherein the cooling gas is injected first to form a cyclonic airflow followed by injecting the cooling liquid.

33. Apparatus according to claim 29, wherein the cooling means includes a cooling liquid inlet in the breech assembly through which cooling liquid can be pumped into the bore when the valve means is open.

34. Apparatus according to claim 24, wherein the cooling means is utilised to inject a jet of gas, liquid or combination a misfired projectile from the bore when the valve means is open.

35. A weapon comprising a barrel having a bore therein for firing a projectile, and a firing apparatus according to claim 1 provided on the barrel extending inwardly from one end thereof.

36. A weapon according to claim 35, being an artillery gun.

37. A weapon according to claim 35, being a mortar gun.

38. A firing apparatus for a weapon adapted to fire projectiles, the weapon being of the type comprising a barrel having a bore therein, the firing apparatus comprising:

a breech assembly adapted to be secured to the barrel;

a firing mechanism adapted to initiate firing of the projectile from the bore;

a blower in fluid communication with the barrel and adapted to suck air from the bore during loading of the projectile; and a cooling means adapted to deliver a cooling medium comprised of either a cooling gas, a cooling liquid or a combination thereof to the bore after firing of the projectile.

39. Apparatus according to claim 38, wherein the cooling means includes a cooling gas inlet in the breech assembly through which cooling gas can be pumped into the bore when a valve means disposed between the projectile and the firing mechanism is open.

* * * * *